US007367777B2

(12) United States Patent
Graves et al.

(10) Patent No.: US 7,367,777 B2
(45) Date of Patent: May 6, 2008

(54) FAN BLADE AIR FILTER

(76) Inventors: E. Dean Graves, P.O. Box 735, 3738 W. 1st St., Thatcher, AZ (US) 85552; Donald J. Booty, Jr., 5522 E. Dusty Wren Dr., Cave Creek, AZ (US) 85331

( * ) Notice: Subject to any disclaimer, the term of this patent is extended or adjusted under 35 U.S.C. 154(b) by 555 days.

(21) Appl. No.: 10/955,014

(22) Filed: Sep. 30, 2004

(65) Prior Publication Data

US 2006/0067831 A1 Mar. 30, 2006

(51) Int. Cl.
*F01D 25/00* (2006.01)

(52) U.S. Cl. ..... 416/5; 416/62; 416/146 R

(58) Field of Classification Search ..... 416/5, 416/62, 146 R, 231 R
See application file for complete search history.

(56) References Cited

U.S. PATENT DOCUMENTS 4,840,650 A * 6/1989 Matherne ..... 55/385.1
5,022,819 A * 6/1991 Murcin et al. ..... 416/62
5,145,500 A * 9/1992 Nolen, Jr. ..... 55/501
5,370,721 A * 12/1994 Carnahan ..... 96/124
5,460,787 A * 10/1995 Colon ..... 422/123
5,562,412 A * 10/1996 Antonelli ..... 416/62

* cited by examiner

*Primary Examiner*—Hoang Nguyen

(57) ABSTRACT

A filter assembly for mounting on a conventional or ceiling fan blade includes a fan blade mount, a filter mount, and an air filter. The fan blade mount has a blade mount slot formed therein that is dimensioned to slidably engage a ceiling fan blade. The filter mount is coupled to the fan blade mount and has at least a portion thereof that is disposed substantially perpendicular thereto. The air filter is coupled to the filter mount and extends a distance therefrom in a direction perpendicular to at least a portion of the fan blade mount slot.

5 Claims, 7 Drawing Sheets

FAN BLADE AIR FILTER

TECHNICAL FIELD

The present invention relates to filters and, more particularly, to a filter assembly that is mountable on a blade of a ceiling fan, or various other conventional fan blades.

BACKGROUND

Many residential homes and commercial buildings have one or more ceiling fans installed in one or more rooms. Typically, ceiling fans are selectively operable to rotate at variable rotational speeds and directions, to provide a desired level of cooling and/or air circulation within a room or building. As is generally known, a ceiling fan typically includes a motor and a plurality of blades. The motor may be installed within a housing that may be adapted to mount to the ceiling, either substantially flush therewith or slightly below the ceiling surface. In either case, the plurality of blades extend perpendicularly from the housing, and are rotated by the motor to provide the previously-mentioned enhanced cooling and/or air circulation.

As many homeowners and building maintenance personnel are aware, during ceiling fan operation, dust and other airborne particulate are drawn into the fan. A portion of the dust and particulate may be circulated with the air, and another portion may accumulate on the ceiling fan blades. This accumulated dust and particulate can, after a period time, become unsightly. Thus, the fan blades may need periodic cleaning to remove the accumulated dust and particulate. This can be a time-consuming task. Moreover, depending on the height and mounting arrangement of the fan, this can also be potentially hazardous for the person conducting the task. The dust and particulate that is present in the air can also be a health nuisance.

Hence, there is a need for a device that can substantially eliminate accumulated dust and particulate on ceiling fan blades, or at least lessen the periodicity at which accumulated dust and particulate on ceiling fans blades needs to be removed. There is also a need for a device that can passively remove dust and particulate from the air. The present invention addresses at least these needs.

BRIEF SUMMARY

The present invention provides a filter assembly that is mountable on the blades of a conventional or ceiling fan, and which reduces the amount of dust and particulate accumulated on the ceiling fan blades, and thus the frequency at which the fan blades need to be cleaned.

In one embodiment, and by way of example only, a filter assembly includes a fan blade mount, a filter mount, and an air filter. The fan blade mount has a blade mount slot formed therein that is dimensioned to slidably engage a ceiling fan blade. The filter mount is coupled to the fan blade mount and has at least a portion thereof that is disposed substantially perpendicular thereto. The air filter is coupled to the filter mount and extends a distance therefrom in a direction perpendicular to at least a portion of the fan blade mount slot.

These and other features and advantages of the preferred fan blade filter will become apparent from the following detailed description taken in conjunction with the accompanying drawings which illustrate, by way of example, the principles of the invention.

DETAILED DESCRIPTION OF PREFERRED EMBODIMENTS

Figure 1:
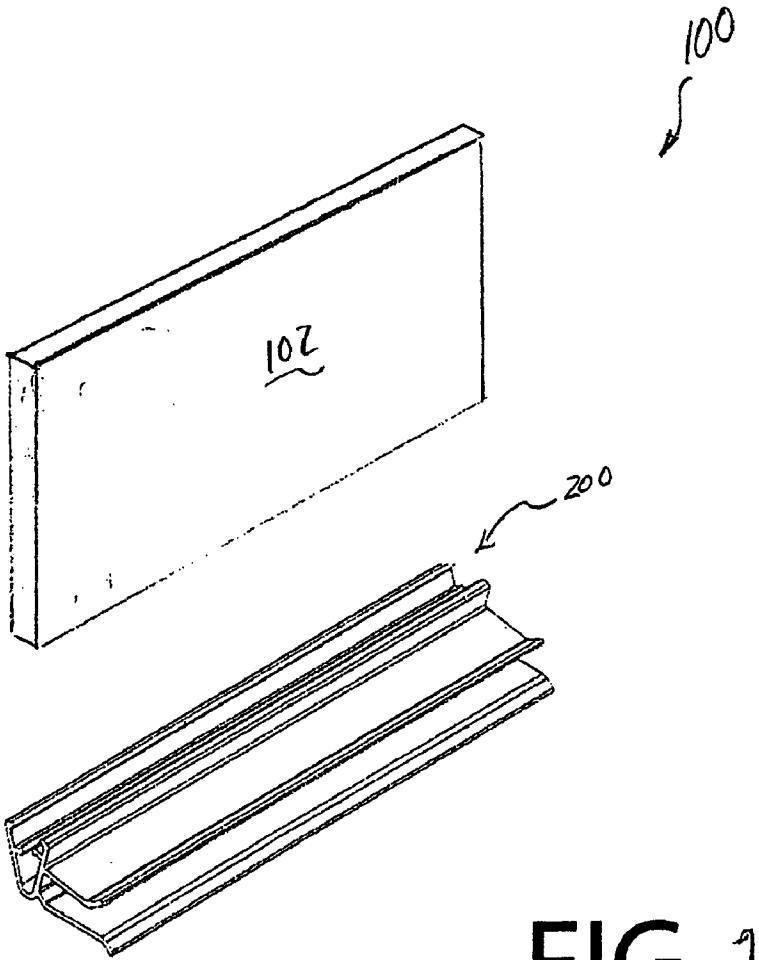
FIG. 1 is an exploded perspective view of an exemplary embodiment of a ceiling fan blade filter assembly according to the present invention.

An exploded perspective view of an exemplary embodiment of a ceiling fan blade filter assembly 100 is shown in FIG. 1. The filter assembly 100 includes a fan blade filter mount 200 and an air filter 102. The fan blade filter mount 200, which is described in more detail further below, is configured to mount on a standard ceiling fan blade (not shown in FIG. 1), and to appropriately secure the air filter 102 thereto. The air filter 102 may be made of any one of numerous types of porous filter materials, so long as the material is sufficiently porous to pass air therethrough, while at the same time capture dust and other particulate that may be suspended in the air flowing through the air filter 102. Some non-limiting examples of appropriate materials include fiberglass, paper, or combinations thereof. The air filter 102, no matter its particular material construction or shape, is mounted in the fan blade filter mount 200, which will now be described in more detail.

Figure 2:
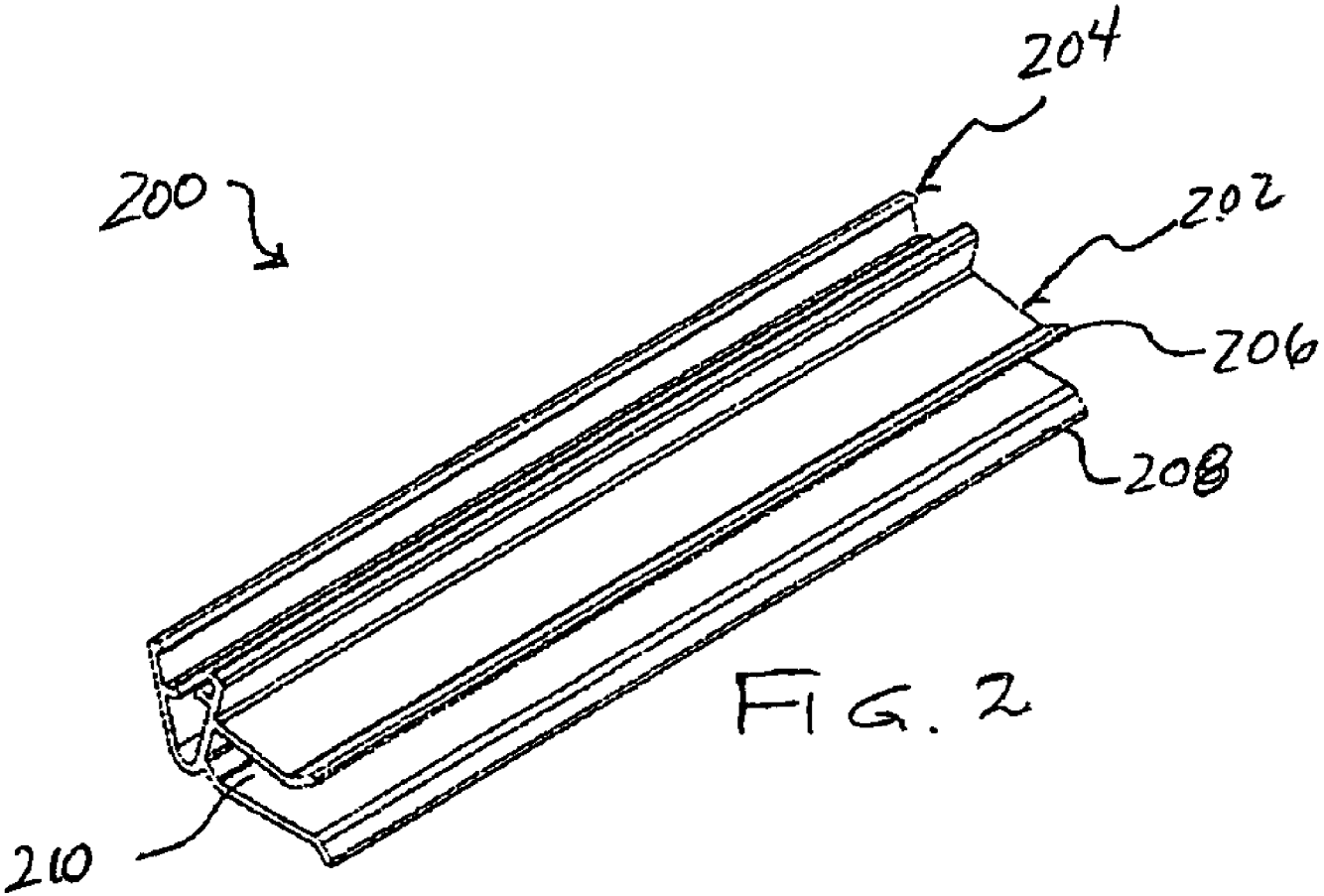
FIG. 2 is a perspective view of an exemplary embodiment of a ceiling fan blade filter mount device that forms part of the assembly of FIG. 1.

The fan blade filter mount device 200, which is illustrated more clearly in FIG. 2, includes a fan blade mount 202 and a filter mount 204, which are coupled to, and disposed substantially perpendicular to, one another. In the depicted embodiment, the fan blade mount 202 and filter mount 204 are constructed of a polymer material, and are integrally formed by, for example, an extrusion process. It will be appreciated that this material and process are each merely exemplary of a particular preferred embodiment, and that materials and/or processes could be used to form the device 200. For example, all or portions of the fan blade mount 202 and filter mount 204 could be separately formed and then individually coupled to one another. Moreover, alternative materials such as, for example, resin, wood, metal, or cellulose could be used as the material of construction that provides the desired rigidity and flexibility.

No matter the particular construction method or material, as will be described more fully below the fan blade mount 202 is adapted to mount to a ceiling fan blade (not shown). In particular, the fan blade mount 202 includes two arms—an upper arm 206 and a lower arm 208, that are coupled to the fan blade mount 204. The upper arm 206 and a lower arm 208 each extend from the fan blade mount 204, and are spaced apart from one another to form a blade mount slot 210 between the two arms 206, 208. As will be shown and described more fully below, the blade mount slot 210 is dimensioned to slidably engage a ceiling fan blade.

Figure 3:
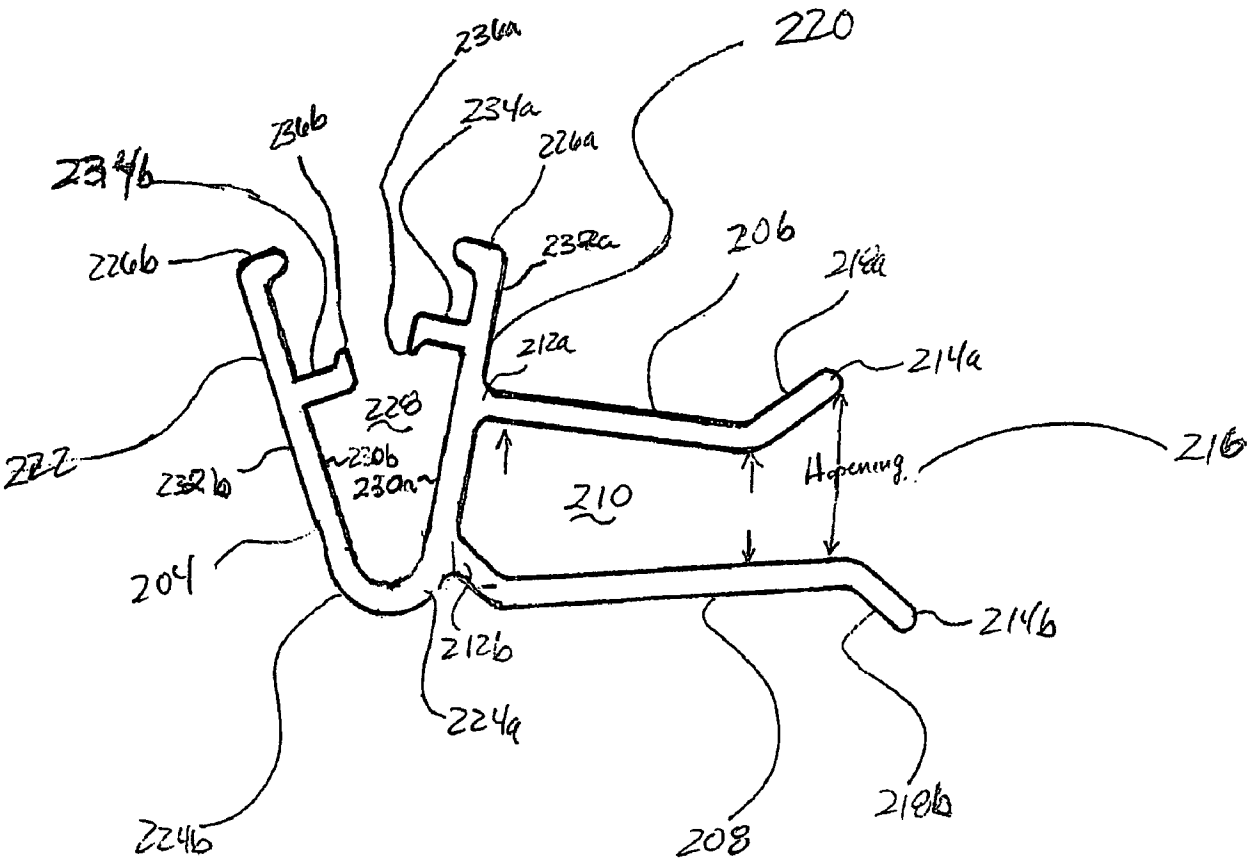
FIG. 3 is a cross section view of the exemplary ceiling fan blade filter mount device of FIG. 2.

In the depicted embodiment, and as shown more clearly in FIG. 3, the fan blade mount upper 206 and lower 208 arms each include, respectively, a fixed end 212*a*, 212*b* and a free end 214*a*, 214*b*. The upper and lower arm fixed ends 212*a*, 212*b* are each coupled to the filter mount 204, and the upper 206 and lower 208 arms extend, in a cantilever fashion, to the respective free ends 214*a*, 214*b*. The upper and lower arm free ends 214*a*, 214*b* are spaced apart from one another and form an opening 216 into the blade mount slot 210. As FIG. 3 additionally shows, the upper 206 and lower 208 arms each preferably include an angled section 218*a*, 218*b* disposed proximate the respective free end 214*a*, 214*b*. The angled sections 218*a*, 218*b* extend upwardly and downwardly, respectively, away from the opening 216. In the depicted embodiment, the upper 206 and lower 208 arms are also configured to slightly angle toward one another, and the length of the upper arm 206 is less than that of the lower arm 208.

With the above-described configuration, and with continued reference to FIG. 3, it is seen that the blade mount slot 210 is dimensioned such that its height gradually decreases from the opening 216 to a minimum height ($H_{min}$) at a position between the free 214*a*, 214*b* and fixed 212*a*, 212*b* ends, and then gradually increases from the minimum height position ($H_{min}$) to the fixed ends 212*a*, 212*b*. It will be appreciated that the height of the opening ($H_{opening}$) is greater than the thickness of a standard ceiling fan blade, and that the slot minimum height ($H_{min}$) is slightly less than the thickness of a standard ceiling fan blade. As will be described more fully below, this preferred slot configuration, in combination with the rigid, yet flexible nature of the material, facilitates spreading of the upper 206 and lower 208 arms as the blade mount 202 engages a ceiling fan blade by slidably engaging the blade into the blade mount slot 210.

Before proceeding with a description of the filter mount section 104, it should be appreciated that the above-described configuration, relative length, and spacing of the upper 206 and lower 208 arms is merely exemplary of a particularly preferred embodiment, and that other configurations, relative lengths, and spacing schemes could be used.

Turning now to the filter mount 204, and with continued reference to FIG. 3, it is seen that this section of the device 100, similar to the fan blade mount 202, includes two arms—an inner arm 220 and an outer arm 222. In the depicted embodiment, the inner 220 and outer 222 arms are integrally coupled to one another; however, as was previously mentioned, this is merely exemplary, and the arms could be separately formed and then subsequently coupled together. In any case, in the depicted embodiment each arm 220, 222 includes a respective fixed end 224*a*, 224*b*, and a respective free end 226*a*, 226*b*. The fixed ends 224*a*, 224*b* are coupled to one another, and the inner 220 and outer 222 arms extend, in cantilever fashion, toward the respective free ends 226*a*, 226*b*.

The inner 220 and outer 222 arms are spaced apart from one another to form a filter mount slot 228 between the two arms 220, 222, and are configured such that the filter mount 204 has a substantially U- or V-shaped cross section. The inner 220 and outer 222 arms also each include a respective inner surface 230*a*, 230*b*, and a respective outer surface 232*a*, 232*b*. In the depicted embodiment, the fan blade mount upper 206 and lower 208 arms are each coupled to the outer surface 232*a* of the filter mount section inner arm 220. Thus, the fan blade mount slot 210 and the filter mount slot 228 are disposed substantially perpendicular to one another. As has been previously stated numerous times, it will be appreciated that this configuration is merely exemplary of a particular preferred embodiment.

The filter mount 204 additionally includes a plurality of engagement arms 234. In the depicted embodiment, two engagement arms 234*a*, 234*b* are included, though it will be appreciated that more than this number could be used. No matter the particular number, it is seen that the engagement arms 234*a*, 234*b* are coupled, one each, to the inner surface 230 of one of the inner 220 and outer 222 arms. In particular, a first engagement arm 234*a* is coupled to the inner surface 230*a* of the inner arm 220, and a second engagement arm 234*b* is coupled to the inner surface 230*b* of the outer arm 222. As may be seen most readily from FIG. 3, the first 234*a* and second 234*b* engagement arms each extend substantially perpendicularly from the respective inner surfaces 230*a*, 230*b* from different axial positions along the respective inner 220 and outer 222 arms. Thus, the first 234*a* and second 234*b* engagement arms are spaced apart from one another. Each arm 234*a*, 234*b* also includes an engagement section 236*a*, 236*b* that extends substantially perpendicularly in a downward and upward direction, respectively. The engagement arms 236*a*, 236*b*, as will now be described, are configured to engage one another, as well as the air filter 102, to thereby secure the air filter 102 within the filter mount slot 228.

Figure 4:
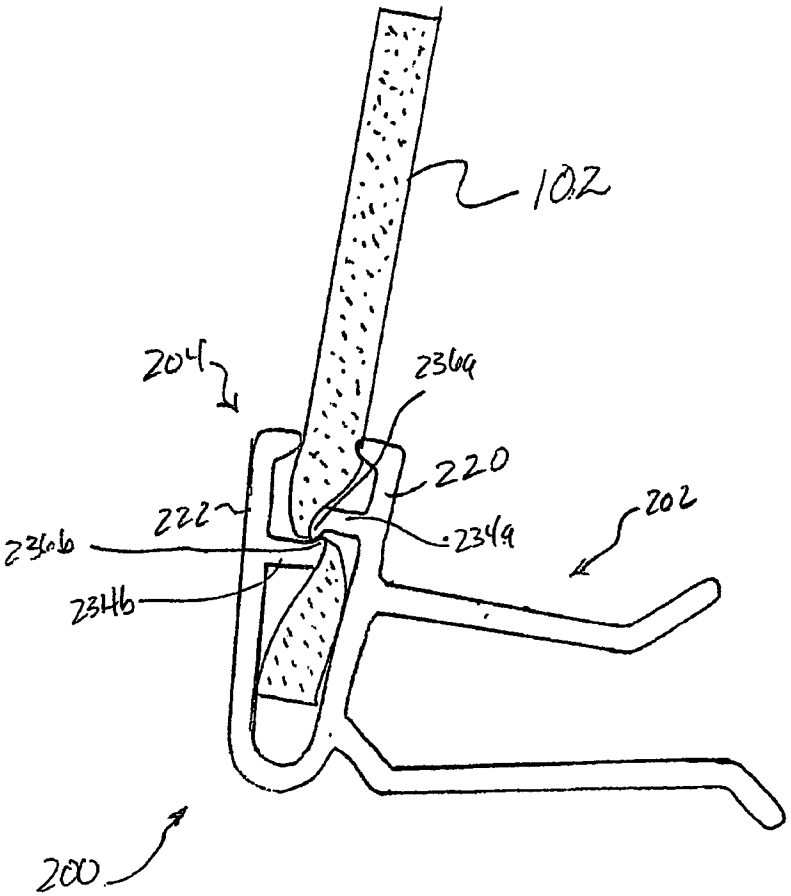
FIGS. 4-6 illustrate an exemplary method of assembling and mounting the exemplary assembly shown in FIG. 1.
Figure 5:
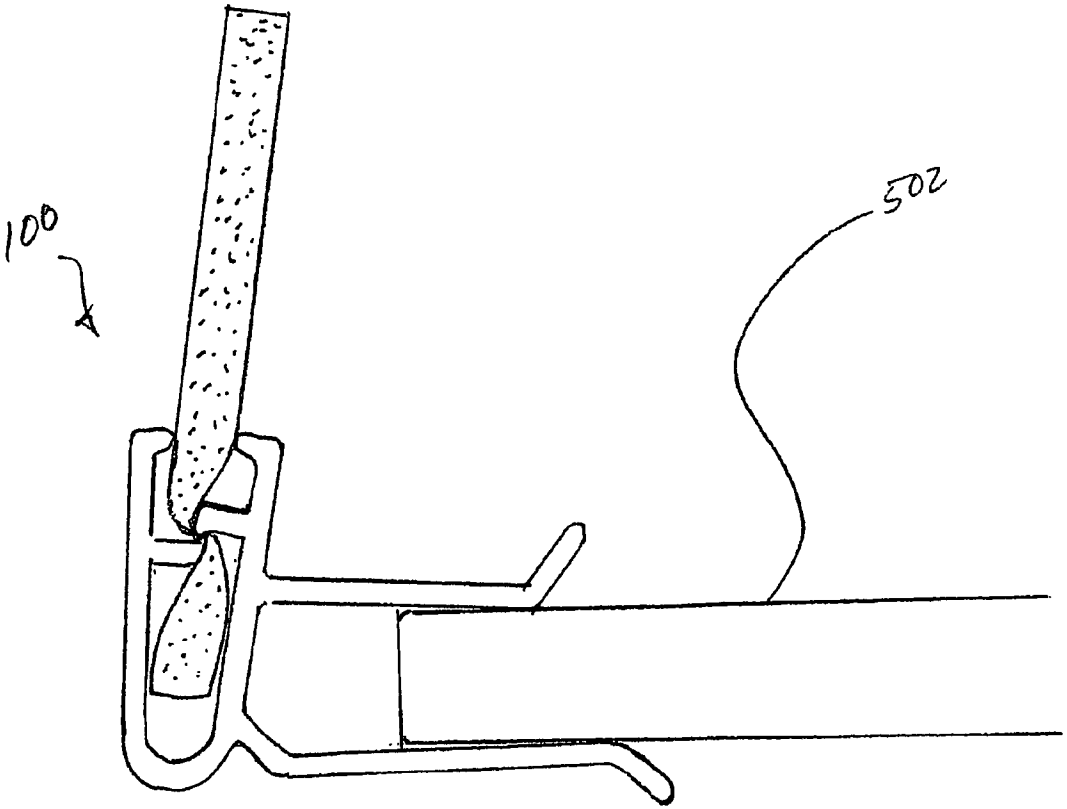
Figure 6:
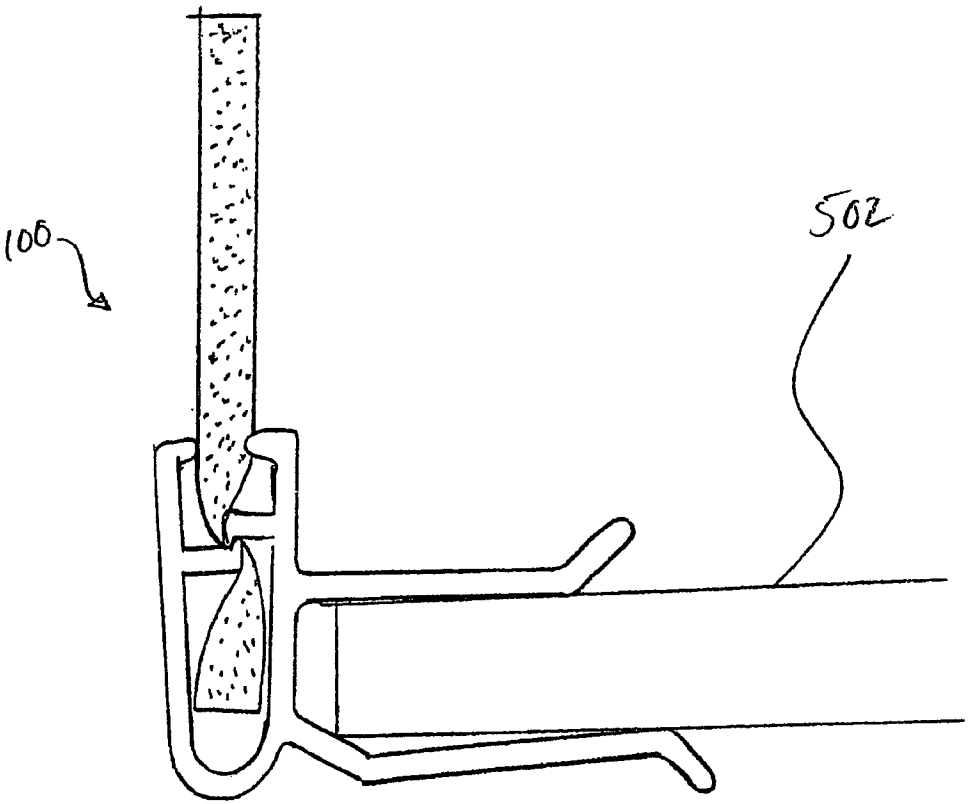

Referring to FIGS. 4-6, a method of assembling and mounting the fan blade filter assembly 100 will now be described. In a particular preferred embodiment, the fan blade filter assembly is provided as a kit, that includes the air filter 102 and mount device 200, though it will be appreciated that these could be provided separately. In either case, as shown in FIG. 4, preferably the air filter 102 is first inserted into the filter mount slot 228. The distance the air filter 102 is inserted into the filter mount slot 228 may vary, so long as it can be properly secured therein. Next, the filter mount section inner 220 and outer 222 arms are moved toward one another, either by hand, manually assisted with a tool, or by a machine-automated process, at least until the engagement arms 234*a*, 234*b* engage one another, via a snap fit facilitated by the respective engagement sections 236*a*, 236*b*. Thereafter, the fan blade filter assembly 100 is mounted onto a ceiling fan blade 502. As was mentioned above, and as is clearly seen in FIGS. 5 and 6, the fan blade mount slot 210 configuration, in combination with the rigid, yet flexible nature of the material, facilitates spreading of the upper 206 and lower 208 arms as the blade mount 202 engages the ceiling fan blade 502.

Figure 7:
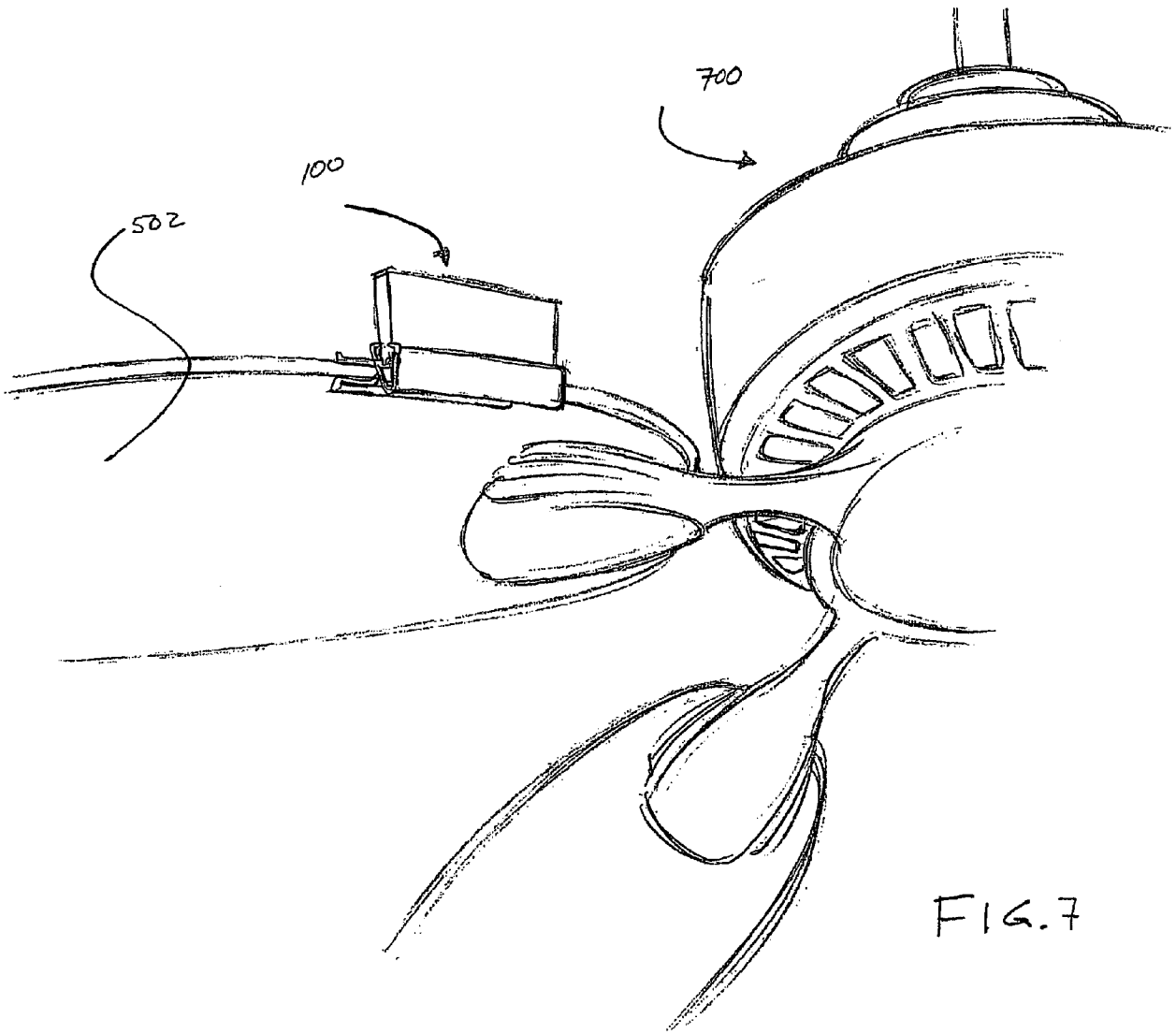
FIG. 7 shows the fan blade filter assembly of FIG. 1 mounted on a ceiling fan.

Although only a single assembly 100 is shown in FIG. 7, it will be appreciated that a fan blade filter assembly 100 is preferably assembled and mounted onto each ceiling fan blade 502 of a particular ceiling fan 700. Thus, it will be appreciated that the kit may be provided with a plurality of air filters 102 and mount devices 200. It will additionally be appreciated that the air filters 102, after a period of use, will accumulate a volume of dust and other particulate such that the air filter 102 may need cleaning. The fan blade filter mount device 200 configuration allows the assembly 100 to be readily removed from the ceiling fan blade 104 and, if desired, to remove the air filter 102 therefrom for cleaning. It will also be appreciated that the air filter 102 can be cleaned without removing it from the mount device 200.

The filter assembly 100 disclosed herein is mountable on the blades of a ceiling fan, or any one of numerous other conventional types of rotating fans. The filter assembly 100 reduces the amount of dust and particulate accumulated on the fan blades, and the frequency at which the fan blades need to be cleaned.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A filter assembly, comprising:

a fan blade mount having a blade mount slot formed therein that is dimensioned to slidably engage a fan blade;

a filter mount coupled to the fan blade mount and having at least a portion thereof that is disposed substantially perpendicular thereto, the filter mount including an inner arm and an outer arm spaced apart from the inner arm to form a filter insertion slot therebetween, the inner and outer arms each including an inner and outer surface;

a first engagement arm coupled to the inner arm outer surface, the first engagement arm extending perpendicularly from the inner arm outer surface;

a second engagement arm coupled to the outer arm inner surface, the second engagement arm extending perpendicularly from the outer arm inner surface; and an air filter disposed within the filter insertion slot and coupled to the filter mount, the air filter extending a distance from the filter mount in a direction perpendicular to at least a portion of the fan blade mount slot, wherein the first and second engagement arms engage one another, to thereby hold the air filter in the filter insertion slot.

2. The filter assembly of claim 1, wherein the fan blade mount comprises:

an upper arm coupled to, and extending from, the filter mount; and a lower arm coupled to, and extending from, the filter mount, the lower armed spaced apart from the upper arm to form the blade mount slot between the upper and lower arms.

3. The filter assembly of claim 1, wherein the filter mount has a substantially U-shaped cross section.

4. The filter assembly of claim 1, wherein the filter is substantially coextensive with the filter mount.

5. A kit for a fan blade filter assembly, the kit comprising:

an air filter; and a fan blade filter mount device including:

a fan blade mount having a blade mount slot formed therein that is dimensioned to slidably engage a fan blade, and a filter mount coupled to the fan blade mount and having at least a portion thereof that is disposed substantially perpendicular thereto, the filter mount having a filter mount slot formed therein that is dimensioned to receive the air filter therein and including an inner arm and an outer arm spaced apart from the inner arm to form a filter insertion slot therebetween. the inner and outer arms each including an inner and outer surface, a first engagement arm coupled to the inner arm outer surface, the first engagement arm extending perpendicularly from the inner arm outer surface, and a second engagement arm coupled to the outer arm inner surface, the second engagement arm extending perpendicularly from the outer arm inner surface.

wherein the first and second engagement arms are configured to engage one another, to thereby hold the air filter in the filter insertion slot.

* * * * *